United States Patent [19]

Pierce

[11] 4,320,741

[45] Mar. 23, 1982

[54] FIREPLACE HEATER STOVE

[76] Inventor: Harold W. Pierce, 4018 Highpoint Rd., Ellicott City, Md. 21043

[21] Appl. No.: 59,658

[22] Filed: Jul. 23, 1979

[51] Int. Cl.[3] ..... F24C 1/14; F24B 3/00

[52] U.S. Cl. ..... 126/123; 126/121; 126/138; 126/61; 126/63

[58] Field of Search ..... 126/136, 121, 120, 138, 126/139, 123, 61, 76, 77, 140, 5, 52, 53, 110 B, 6, 63, 64, 66, 67, 88, 89, 90 R, 126; 237/51

[56] References Cited

U.S. PATENT DOCUMENTS

| | | | |
|---|---|---|---|
| 543,742 | 7/1895 | Loy et al. | 126/61 |
| 1,044,724 | 11/1912 | Atteberry | 126/76 |
| 1,649,881 | 11/1927 | Williamson | 126/121 |
| 2,033,911 | 3/1936 | Digby | 126/5 |
| 2,703,567 | 3/1955 | Manchester et al. | 126/121 |
| 2,789,554 | 4/1957 | Dupler | 126/63 |
| 4,136,662 | 1/1979 | Willson | 126/61 |
| 4,140,101 | 2/1979 | Glover | 126/61 X |
| 4,233,955 | 11/1980 | McCallum et al. | 126/61 |

*Primary Examiner*—Larry Jones
*Attorney, Agent, or Firm*—Marc Block

[57] ABSTRACT

A cylindrical wood-burning firebox is surrounded by a cylindrical metal outer shell which together comprise a convection heater stove which fits into any of various sizes of fireplaces with the cylinder axes directed into the fireplace. Room air enters the lower front portion of the stove between the firebox and the outer shell, is drawn toward the rear of the heater stove, rises between the firebox and the outer shell as the air is heated by the firebox, and exits as hot air from the upper front of the stove between the firebox and the outer shell. The front face of the firebox is recessed relative to the outer shell. A coil through which a fluid can flow can be provided in the gap between the firebox and the outer shell, said coil having an axis also directed into the fireplace.

11 Claims, 7 Drawing Figures

FIREPLACE HEATER STOVE

TECHNOLOGICAL CONTEXT OF THE INVENTION

In response to the desires and needs of an energy-consuming public, various wood-burning heating systems—some of which fit into fireplaces—have been and are being developed.

One such apparatus, disclosed by Loy et al in U.S. Pat. No. 543,702, discloses a cylindrical fire-chamber contained within a cylindrical casing to provide convection heating. The airflow in Loy et al, however, is through "inlet and outlet perforations" which restrict not only the amount of air entering the heating apparatus but also the area of the inner fire-chamber over which the air flows and convection produced. Fitting the Loy et al apparatus into a fireplace is not contemplated.

Also showing two concentric cylindrical elements in a wood-burning convection heater, Lewis in U.S. Pat. No. 4,128,094 teaches air flow about the circumference of the inner portion of the structure (shown by arrows 8). Lewis does not readily adapt to being fit into a fireplace.

A patent (U.S. Pat. No. 1,255,493) by Williams shows a heater fit into a fireplace wherein cold air is drawn in at a bottom grating and air, heating by convection, is forced out through a top grating. The heater of Williams is rectangular and provides flues which directs, but nonetheless restricts, air flow.

Moncrieff-Yates (U.S. Pat. No. 4,096,849), like Williams, shows another fireplace unit which is not cylindrical and sends heat convected air through a duct. Moncrieff-Yates channels air over a bed plate, the angle of which is of great significance.

Techniques currently used fail to provide unobstructed, even heating to a flow of air passing through an air gap between two concentric cylinders, the inner cylinder being a firebox enclosed on all sides except for a flue which enters a fireplace chimney. Further, none of the techniques employ the gap between two cylinders—rather than ducts, pipes, or gratings—to provide a path for air to be heated.

No suggested apparatuses provide for retrofitting a wood-burning stove into fireplaces of a variety of sizes. Nor do these apparatuses teach the large surface area of heating, the smooth airflow resulting air passing rounded surfaces, and the safety of recessing the hot inner cylinder and permitting only the warmer outer cylinder to jut out.

SUMMARY OF THE INVENTION

To improve and enhance heaters proposed by others, the present invention provides an inner cylinderical wood-burning firebox sealable except for an exit flue going into a fireplace chimney and surrounded by an outer cylindrical shell both open at the front and separated from the walls and back of the firebox by an air gap. The firebox and outer shell fit into a fireplace, a large plate being attached to the exterior of the outer shell and set to one of various axial positions along the outer shell and being affixed to the fireplace.

The firebox is provided with a through-draft and a Venturi down-draft air inlet to enhance the heating therein. A baffle is also included to direct gas flow for secondary burn.

Finally, the provision of a coil, through which heatable fluid flows, wound about the firebox to yield a total, combination heating unit is specifically discussed.

The present invention, due to its curvature and the direction of airflow (parallel to the axis of the firebox and outer shell), provides even and continuous heating.

The outer shell protrudes relative to the firebox. The possibility of an object or person touching the hot, recessed firebox is greatly diminished. The outer shell does not get hot enough to scar if touched or set an object afire. Enhanced safe operation is thus an object of the invention.

Being cylindrical, wood as it burns moves to the center of the cylindrical "floor" of the firebox, leading to more thorough burning.

Finally, the present invention is aesthetically pleasing and can be readily used in many houses as a fireplace insert or free-standing stove without requiring modifications to the house.

DESCRIPTION OF THE INVENTION

Figure 1:
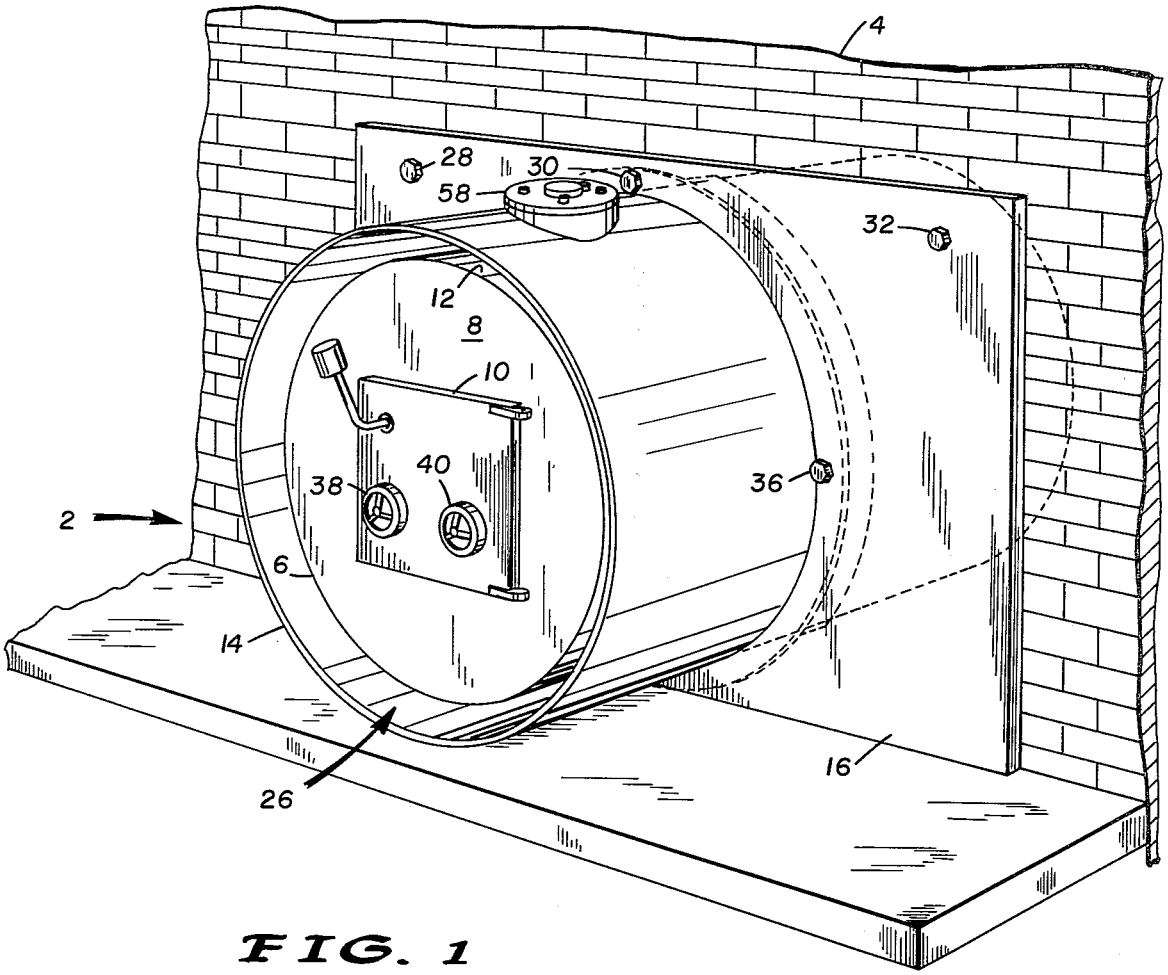
FIG. 1 is a perspective drawing showing the fireplace stove of the invention fit into a fireplace.
Figure 2:
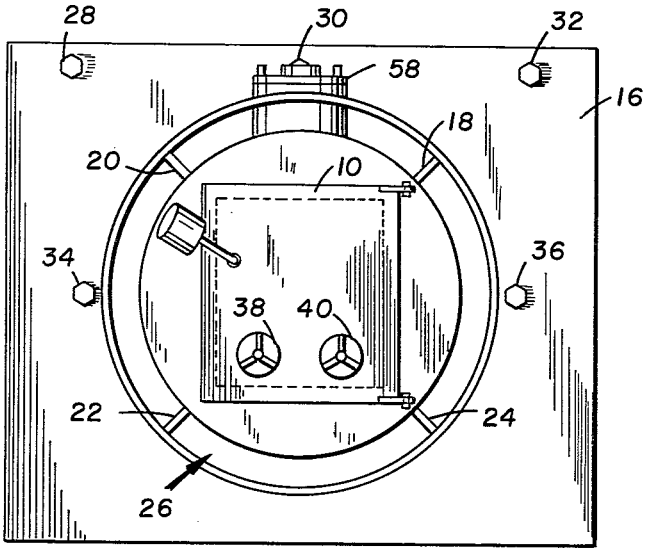
FIG. 2 is a front view of the present invention.

Referring to FIG. 1, the heater stove 2 of the present invention is shown in its environment, fit into a fireplace 4. A firebox 6 is shown as a cylinder having a front face 8 in which a door 10 is placed and having its cylindrical wall 12 (see FIGS. 4 and 5) extending into the fireplace 4. Encompassing the firebox 6 is an outer cylindrical shell 14 which has no front face and which is connected to a front plate 16. The front plate 16 is sealedly affixed to the fireplace 4. The firebox 6 and the outer shell 14 are shown connected to each other by brackets 18, 20, 22, and 24. A ring-shaped gap 26, between the firebox 6 and the outer cylindrical shell 14, in FIG. 1 is also shown in the front view of FIG. 2 and the cutaway front view of FIG. 3. Bolts 28 and 32 (also shown in FIG. 2) are provided in FIG. 1 for affixing the front plate 16 to the fireplace 4. Bolts 30, 34, and 36 connect front plate 16 to a flange ring 17 which attaches the front plate 16 to the outer cylindrical shell 14. In both FIG. 1 and FIG. 2 through-draft elements 38 and 40 are shown located in the door 10. In a preferred embodiment, the through-draft elements 39 and 40 can screw and unscrew to cover or uncover an air opening (not shown), thereby allowing less or more air to enter the firebox 6.

Figure 3:
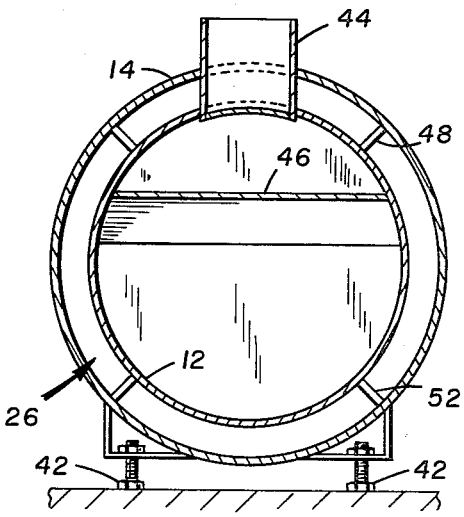
FIG. 3 is a cutaway front view of the present invention.

FIG. 3, which illustrates a front view cut away behind the front plate 16, shows legs 42 on which the outer cylindrical shell 14 rests. A stove-pipe 44 passes through a hole in the top of the outer cylindrical shell 14 and through a hole in top of the firebox 6. A baffle 46 is more clearly seen in the side view of FIG. 4, which also shows the stove-pipe 44 entering the chimney 47 of the fireplace 4.

Figure 4:
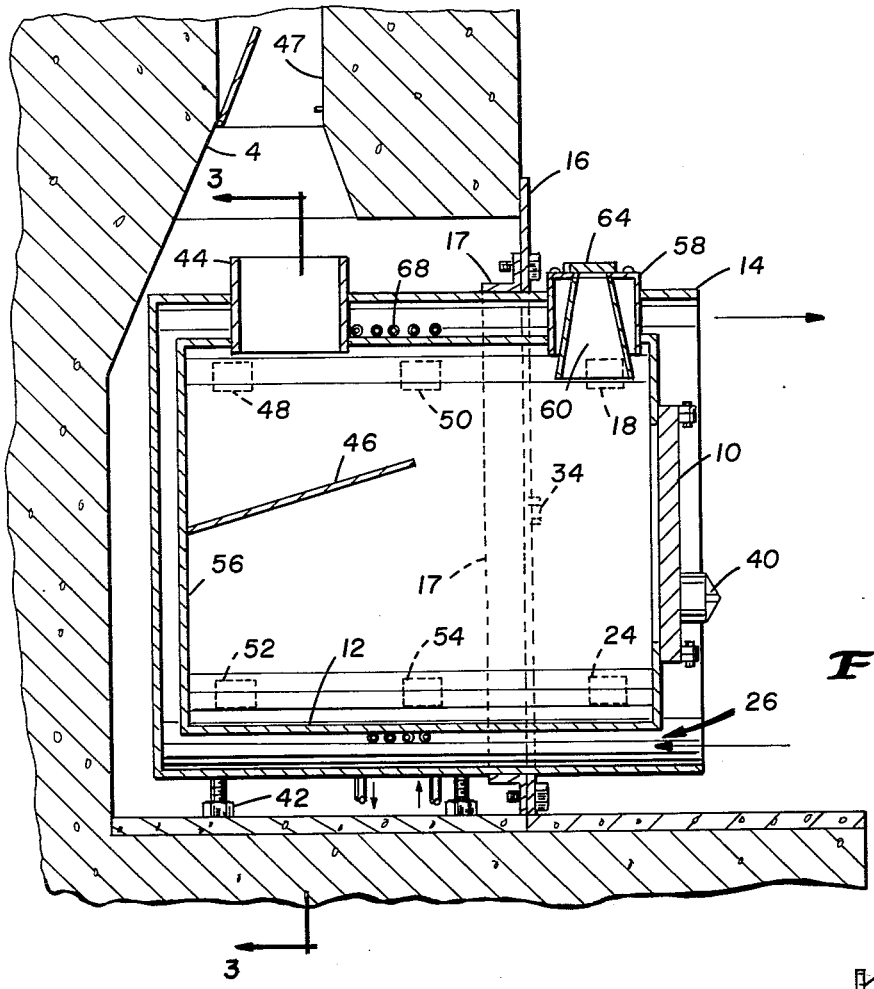
FIG. 4 is a cutaway side-view of the invention showing an inner cylindrical firebox contained within an outer cylindrical enclosure.

Referring to FIG. 4, it is readily seen how the baffle 46 causes gases in the firebox 6, generated when wood is burned therein, to circulate and promote secondary burning within the firebox 6. The baffle 46, together with the cylindrical shape of the firebox 6, contributes to the complete and efficient burning of the wood fuel. In the view of FIG. 4, additional brackets 48, 50, 52, and 54 are shown on the right side connecting the firebox 6 to the outer cylindrical shell 14. A similar bracket arrangement would also be provided on the left side.

It should be noted that the function of these brackets is to provide a support and connection between the firebox 6 and outer cylindrical shell 14 and may, therefore, include any number of arrangement of brackets which do not notably obstruct or direct any flow of air between the front and rear of the ring-shaped gap 26.

In operation, wood (not shown) is burned in the firebox 6 (of FIG. 4). Through-draft 38 is opened as desired to feed in air. The air in the firebox 6 circulates due to the baffle 46 heating the cylindrical wall 12 as well as the back face 56 of the firebox 6. Chimney smoke passes to the chimney 47 via stove-pipe 44. As the firebox 6 heats, cool room air enters the bottom of the ring-shaped gap 26 as indicated by the dashed arrow. The cool air travels to the rear of the heater stove 2 and is heated by the firebox 6 as it travels. As the heated air moves toward the rear of the heater stove 2 it rises. The heated air is expelled throughout the top portion of the ring-shaped gap 26 as shown by the dashed arrows.

With regard to this air flow it should be understood that the bottom portion of the ring-shaped gap 26 comprises approximately the lower half of the ring-shaped gap 26 while the top portion comprises approximately the upper half. Convection currents, it should also be noted, need not flow straight back and straight out (as illustrated by the dashed arrows) but may also follow curved flow paths, the rising of the air as it passes to the rear depending on the heat in the firebox 6 and the temperature in the room among other factors.

Figure 5:
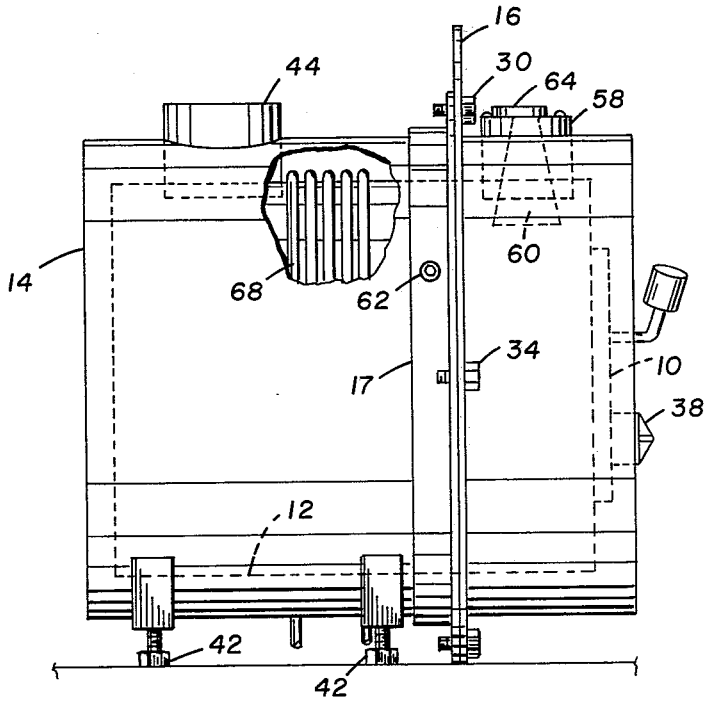
FIG. 5 is a cutaway side-view of an embodiment of the invention which includes a wraparound coil element.
Figure 6:
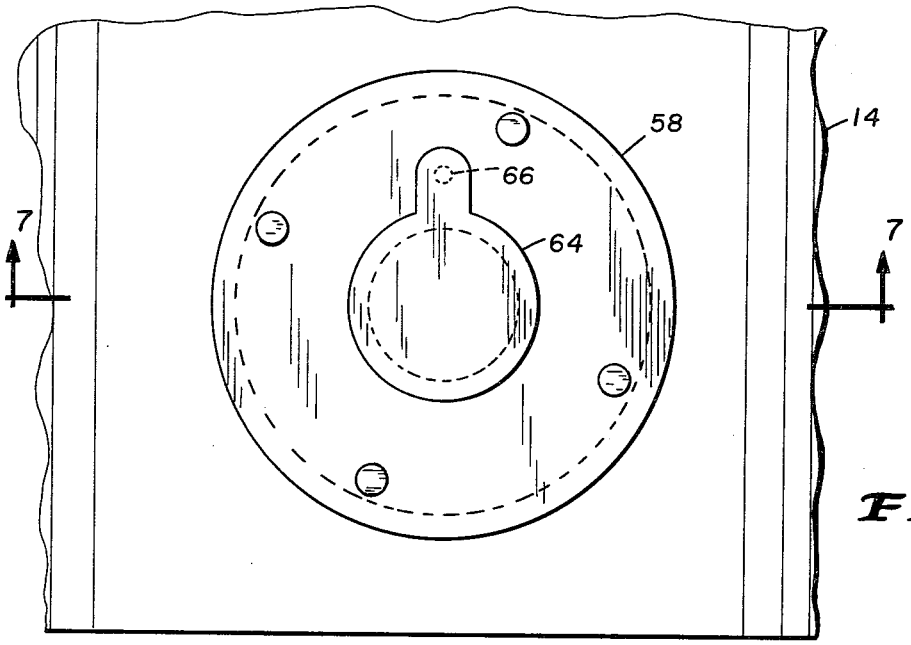
FIG. 6 is a top-view enlargement of a down draft valve shown in FIG. 5.
Figure 7:
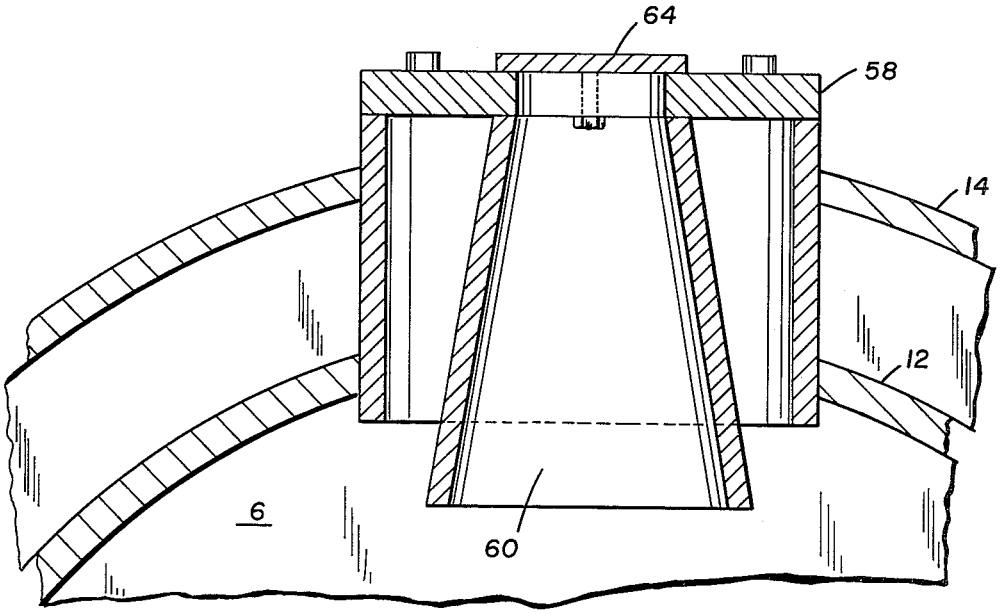
FIG. 7 is a front-view enlargement of a down draft valve shown in FIG. 5.

Referring now to FIG. 5, another embodiment of the invention is shown in cutaway side view. In addition to through-draft elements 38 and 40, a down-draft element 58 with a Venturi aperature 60 is included to inject a controlled stream of room air into the firebox 6 as desired. The exact structure of the down-draft element 58 is depicted in FIGS. 6 and 7. The top view of FIG. 6 shows a cover 64 which can rotate about a pivot point 66 to expose the Venturi aperture 60 to greater air inflow. FIG. 7 shows the round Venturi aperture 60 surrounded by a pipe housing 67, extending through the outer cylindrical shell 14 and the cylindrical wall 12 into the firebox 6.

Referring back to FIG. 5, the heater stove 2 is shown having fluid carrying tubing 68 would about the firebox 6 inside the outer cylindrical shell 14. Cold gas or water pumped through the tubing 68 will be heated. A combination air convection heater and hot water heater, for example, can be provided by the embodiment of FIG. 5. An adjustment screw 62 (or screws), of preferably an Allen head type, passes through the flanged ring 17 to contact outer cylindrical shell 14 and is used to permit motion of the outer cylindrical shell 14 relative to the front plate 16, i.e., into or out from the fireplace 4. To fit into a deeper fireplace, the adjustment screw(s) 62 may be loosened, the firebox 6 and outer cylindrical shell 14 pushed deeper (i.e., to the left in FIGS. 4 and 5) into the fireplace 4, and the adjustment screw(s) 62 retightened.

It should be realized that, although the present invention shows a circular cylinder embodiment, other cylindrical embodiments (such as elliptical or squared) are also within the scope of the invention. Similarly, while the door 10 is illustrated as square, it may also be round and, if desired, large enough to comprise the front face 8 of the firebox 6. Other such modifications are also within the scope of the invention.

What is claimed is:

1. A heater stove which fits into a fireplace, the heater stove comprising:

a cylindrical firebox having (a) a front face, a back face, and a side wall having a closed-curve cross-section extending between the front face and the back face and (b) an axis directed into the fireplace when the heater stove is within the fireplace;

an outer cylindrical shell having a side wall and a back wall, the shell surrounding and being fixedly spaced apart from the back face and the side wall of the firebox, the shell and the firebox having an annular gap therebetween, the annular gap having an opening at the front of the stove; and means for dividing the annular gap proximate the opening into a plurality of arcuate regions which extend a short distance in the axial direction, the regions being disposed between the firebox side wall and the shell side wall and the regions including at least one lower region into which unheated air is drawn and at least one upper region from which heated air exits, air drawn through the at least one lower region (a) mixing with air flowing in other of the regions, (b) being heated by the firebox, and (c) exiting through at least one of the at least one upper regions.

2. A heater stove, as in claim 1, further comprising:

a flat plate affixed to the fireplace and having an opening into which the shell and the firebox with the gap therebetween fit; and means for adjustably attaching the shell to the flat plate, providing for adjustment of the position of the shell and the firebox axis relative to the flat plate.

3. A heater stove, as in claim 1, further comprising: coil means, having an axis directed along the firebox axis and being wrapped around the firebox, for carrying a heatable fluid.

4. A heater stove, as in claim 3, wherein the coil means is in direct contact with the firebox.

5. A heater stove, as in claim 3, wherein the coil means has an inlet and outlet each of which passes through the shell.

6. A heater stove, as in claim 1, wherein the outer cylindrical shell extends out from the fireplace and wherein the front face of the firebox is recessed relative to the extended portion of the shell.

7. A heater stove, as in claim 1 or claim 6, wherein the convection heating of the air which flows through the gap defined between the firebox and the shell results in mild heating of the shell relative to the greater heating of the firebox.

8. A heater stove, as in claim 1, further comprising: down-draft means for providing a controlled stream of air from outside the fireplace to the inside of the firebox, wherein said down-draft means comprises a Venturi aperture passing from outside the fireplace through the shell and into the firebox.

9. A heater stove, as in claim 8, wherein said downdraft means comprises:

a Venturi aperture passing from outside the fireplace through the shell and into the firebox; and a pivotable cap adjustably positionable over the Venturi aperture to control the amount of air entering the Venturi aperture.

10. A heater stove, as in claim 9, further comprising: a front door fit into the front face of the firebox; and through-draft means located in the front door for controllably permitting the inflow of air into the firebox.

11. A stove as in claim 1 wherein the dividing means comprises:

brackets between which the regions are defined, the brackets having a short axial length thereby determining the short axial distance over which the regions extend, the short length of the brackets permitting air to flow over and be heated by the entire outer periphery of the firebox.

* * * * *